US005129526A

United States Patent [19]

Craft, Jr. et al.

[11] Patent Number: 5,129,526

[45] Date of Patent: Jul. 14, 1992

[54] NEWSPAPER CONTAINER AND BUNDLER

[75] Inventors: Charles W. Craft, Jr., Apple Creek; Richard R. Lewellen, Wooster, both of Ohio

[73] Assignee: Rubbermaid Incorporated, Wooster, Ohio

[21] Appl. No.: 738,262

[22] Filed: Jul. 31, 1991

[51] Int. Cl.[5] ..... B65B 27/08

[52] U.S. Cl. ..... 206/449; 206/564; 206/503; 206/451; 100/34

[58] Field of Search ..... 206/449, 564, 803, 451, 206/560; 100/34

[56] References Cited

U.S. PATENT DOCUMENTS

| | | | |
|---|---|---|---|
| D. 170,309 | 9/1953 | Curtis et al. | D33/3 |
| D. 249,617 | 9/1978 | Bozicnik | 06/184 |
| 2,364,518 | 12/1944 | Clouser | 100/19 |
| 2,485,419 | 10/1949 | Thompson | 100/19 |
| 2,781,621 | 2/1957 | Wilson | 53/198 |
| 2,818,180 | 12/1957 | Keene | 211/50 |
| 2,965,016 | 12/1960 | Price | 100/1 |
| 3,038,403 | 6/1962 | Orelind | 100/34 |
| 3,357,344 | 12/1967 | Pate | 100/34 |
| 3,491,681 | 1/1970 | Saro, Jr., et al. | 100/34 |
| 3,777,885 | 12/1973 | Barteck | 206/564 |
| 3,850,092 | 11/1974 | Montgomery | 100/34 |
| 4,061,084 | 12/1977 | Bakkeren | 100/1 |
| 4,084,495 | 4/1978 | Paul | 100/34 |
| 4,150,612 | 4/1979 | Kessler | 100/2 |
| 4,512,468 | 2/1985 | Stravitz | 206/564 |
| 4,603,542 | 8/1986 | Reiter et al. | 206/449 |
| 4,776,462 | 10/1988 | Resugi et al. | 206/449 |
| 4,778,056 | 10/1988 | Faulstick et al. | 206/449 |
| 4,964,518 | 10/1990 | Wilson | 211/50 |

OTHER PUBLICATIONS 1 page advertising sheet, "STAK-N-TIE"; Akro-Mils, P.O. Box 989, Akron, OH 44309; date unknown.

1 page advertising sheet, the "PAPER PLACE"; Akro-Mils, P.O. Box 989, Akron, OH 44309; date unknown.

1 page advertising sheet, NEWSPAPER BUNDLER, Tucker Industries, Leominster, MA 01453; date unknown.

Space Saver Catalogue, Apr. 1990, p. 42.

*Primary Examiner*—Joseph Man-Fu Moy

*Attorney, Agent, or Firm*—Renner, Kenner, Greive, Bobak, Taylor & Weber

[57] ABSTRACT

A container (10) for stacking and bundling newspaper (P) or the like includes a rear wall (13) and side walls (11, 12) defining an open front around which is a rim (14). The rear wall (13) and the side walls (11, 12) extend upwardly from a bottom surface (31) and are provided with windows (26, 27, 28) therein. Front pedestals (29, 30) and rear pedestals (32, 33) are positioned at the front and rear of the side walls (11, 12) and have inclined upper newspaper supporting surfaces (34, 35, 36, 37) all lying in the same plane. The bottom surfaces (31) is provided with raised stop surfaces (39, 40, 41) and inclined ramp surfaces (b 43, 44, 45, 46) to locate a ball of twine used to bundle the newspaper (P). The twine may be tied to rear wall (13) through window (28) and draped from back to front along bottom surface (31) and may also be tied to one side wall (11, 12) through window 26) or window (27) and draped from side to side along bottom surfaces (31) so that newspaper (P) resting on the pedestals (29, 30, 32, 33) may be readily bundled. A bag (B) may also be positioned on the pedestals (29, 30, 32, 33) such that its open mouth extends generally upwardly through the open front of the container (10) to receive the newspapers (P).

20 Claims, 4 Drawing Sheets

NEWSPAPER CONTAINER AND BUNDLER

TECHNICAL FIELD

This invention relates to a container for holding newspapers or other like materials. More particularly, this invention relates to such a container which is configured to assist the user in bundling the newspapers upon removal therefrom. Specifically, the container is configured to be versatile and permit the user to stack newspapers directly therein or in a bag conveniently positioned therein.

BACKGROUND ART

For many years people have saved old newspapers to eventually tie the same in bundles or put them in paper bags to be transported to a recycle facility. With the more recent ecological emphasis on recycling of materials, such activity has increased and along with it has evolved an increased need for a container to store the newspapers in a convenient and not unsightly fashion, and to assist in the bundling of the same.

Over the years many devices have been designed in an attempt to meet these needs. For example, U.S. Pat. No. 2,818,180 discloses a rack which has four corner shelves on which a stack of newspapers may be positioned. The shelves are positioned well above the floor on legs so that a bundling cord may be tied around the newspaper. In addition to taking up a large amount of space, this device is also impractical due to weight, storage and other standpoints because, for example, for stability purposes, a table with panels and other elements are deemed necessary.

More recently, a more compact and lighter weight container has been designed as shown in U.S. Pat. No. 249,617. This container, having four upright corners, likewise lacks in stability and moreover permits the newspapers to sag in the center which can be deleterious if care is not taken when placing newspapers, particularly the first several newspapers, in the container. The stability problem has been somewhat solved by an even more recent similar product in which the tops of the four corners are tied together by an upper rim.

Nevertheless, problems with these prior products continue to exist. Most specifically, none of the prior art is configured to accept a paper bag within which the papers can be conveniently positioned if desired. Thus, in the devices of either of the patents discussed hereinabove, if the user wished to place the newspapers in a paper bag rather than tieing the same, the bag could certainly be positioned in the container but then it would have to be removed to position newspapers therein, and then repositioned in the container—totally defeating the purpose thereof.

DISCLOSURE OF THE INVENTION

It is thus a primary object of the present invention to provide a conveniently usable and versatile newspaper container having the ability to hold the newspapers for easy bundling.

It is another object of the present invention to provide a newspaper container, as above, in which the newspapers can be readily positioned in a paper bag carried by the container, if desired.

It is a further object of the present invention to provide a newspaper container, as above, which can readily carry and store balls of twine should the user desire to bundle the newspaper.

It is an additional object of the present invention to provide a newspaper container, as above, which is light weight, yet stable, and which is compact.

These and other objects of the present invention, as well as the advantages thereof over existing prior art forms, which will become apparent from the description to follow, are accomplished by the means hereinafter described and claimed.

In general, a container for stacking and bundling newspapers and the like includes a rear wall, and two opposed side walls defining an open front. Front pedestals are located at the front of each side wall and rear pedestals are located at the rear of each side wall. The pedestals have inclined upper surfaces all lying in the same plane to support the newspapers at an incline within the container.

A preferred exemplary newspaper container and bundler incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
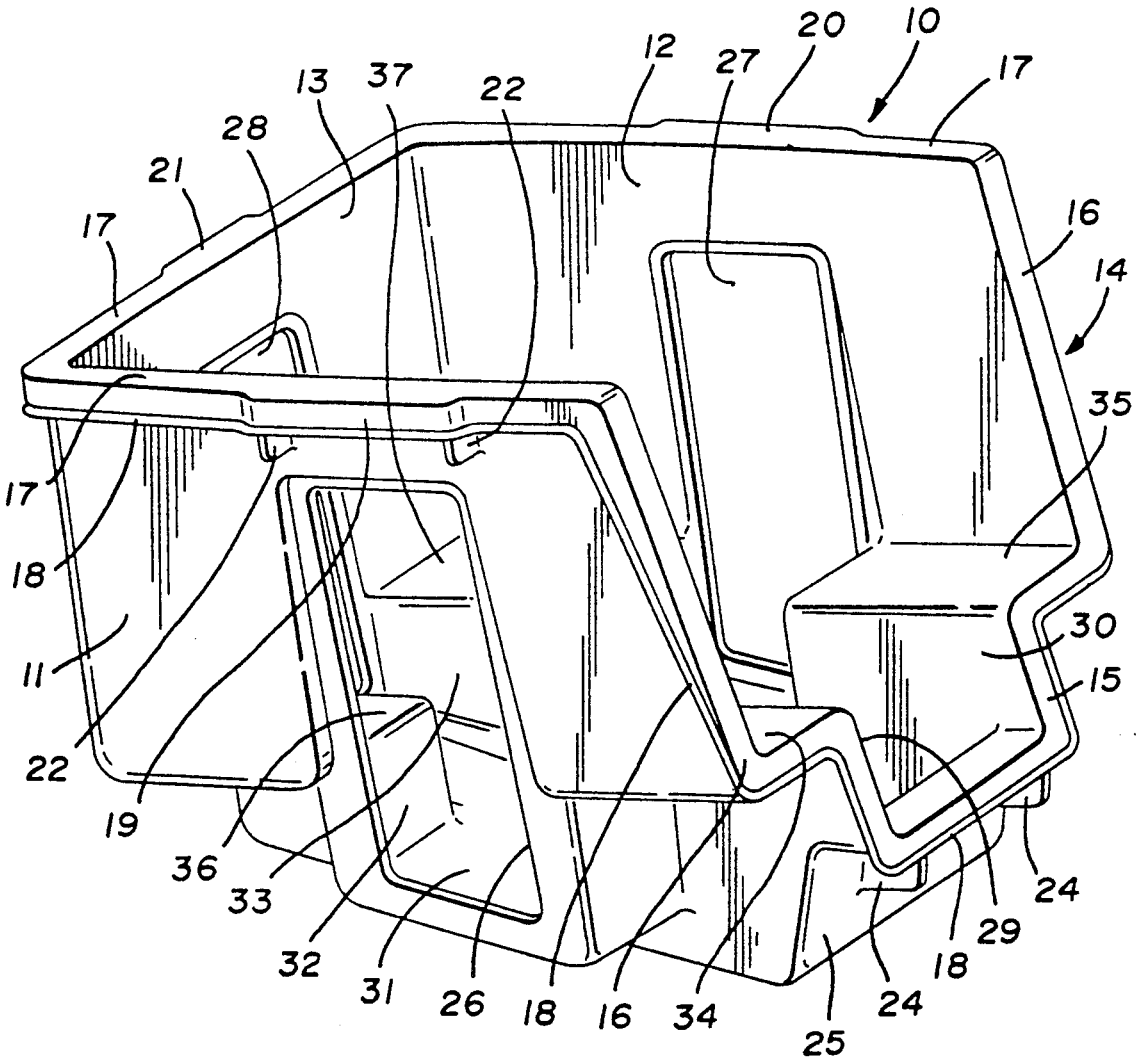
FIG. 1 is a perspective view of a newspaper container and bundler made in accordance with the concepts of the present invention.

A paper bundling container constructed according to the concepts of the present invention is indicated generally by the numeral 10 and is preferably molded out of any suitable plastic material. Container 10 includes generally vertical, but preferably tapered at a slight draft angle, side walls 11, 12 and a rear wall 13. As shown, container 10 has an open front defined by the edges of side walls 11 and 12 having a rim indicated generally by the numeral 14. Front rim 14 includes a lower U-shaped mouth portion 15, the upper end of the branches of which merge into the lower portion of L-shaped front rim portions 16. Front rim 14 is inclined rearwardly with the top of L-shaped portions 16 merging into an upper U-shaped rim 17 at the top of side walls 11 and 12 and rear wall 13. Upper rim 17 defines an open top for container 10.

As shown, rim 17 slopes downwardly from front rim 14 rearwardly toward rear wall 13. Front rim 14 and upper rim 17 may be adorned, if desired, with a complementary rib 18 adjacent thereto and running the entire periphery thereof. In addition, upper rim 17 may be provided with side handles 19 and 20 generally centrally of side walls 11 and 12, respectively, and a rear handle 21 generally centrally of rear wall 13. Side stacking ribs 22 may be provided to extend downwardly along side walls 11 and 12 beneath side handles 19 and 20, rear stacking ribs 23 may be provided to extend downwardly along rear wall 13 beneath handle 21, and front stacking ribs 24 may be provided to extend downwardly along a front pedestal wall 25 below mouth portion 15 of open front rim 14. Together, stacking ribs 22, 23 and 24 enable container 10 to be nested within like containers without the potential of jamming.

Side walls 11 and 12 are provided with generally centrally located, vertically elongated windows 26 and 27, respectively. Similarly, rear wall 13 is also provided with a generally centrally located, vertically elongated window 28. Window 26 is thus located below handle 19, window 27 is below handle 20, and window 28 is below handle 21.

Front corner, paper-supporting pedestals 29 and 30 extend upwardly from the bottom surface 31 of container 10 near the front of side walls 11 and 12, respectively, and are thus positioned inwardly of the junction of side walls 11 and 12, respectively, and the open front of container 10. Likewise, rear corner, paper-supporting pedestals 32 and 33 extend upwardly from bottom surface 31 near the back of side walls 11 and 12, respectively, and are thus positioned inwardly of the junction of side wall 11 and rear wall 13, and side wall 12 and rear wall 13, respectively. As such, window 26 is positioned between pedestals 29 and 32, window 27 is positioned between pedestals 30 and 33, and window 28 is positioned between pedestals 32 and 33.

Pedestals 29, 30, 32, and 33 are provided with generally flat top surfaces 34, 35, 36 and 37, respectively. Top surfaces 34, 35, 36, 37 are all inclined rearwardly, that is, sloping downwardly from front to back, at an angle of preferably about 15° from horizontal. However, surfaces 34, 35, 36 and 37 all lie in the same plane and thus together present a surface upon which newspapers or other papers may be suitably stacked at an incline, being positioned on pedestals 29, 30, 32 and 33 by being passed through the top and front opening of container 10. A serrated surface 38 (FIG. 3) may be provided vertically along window 28 to assist in the facile stacking of such papers.

Figure 4:
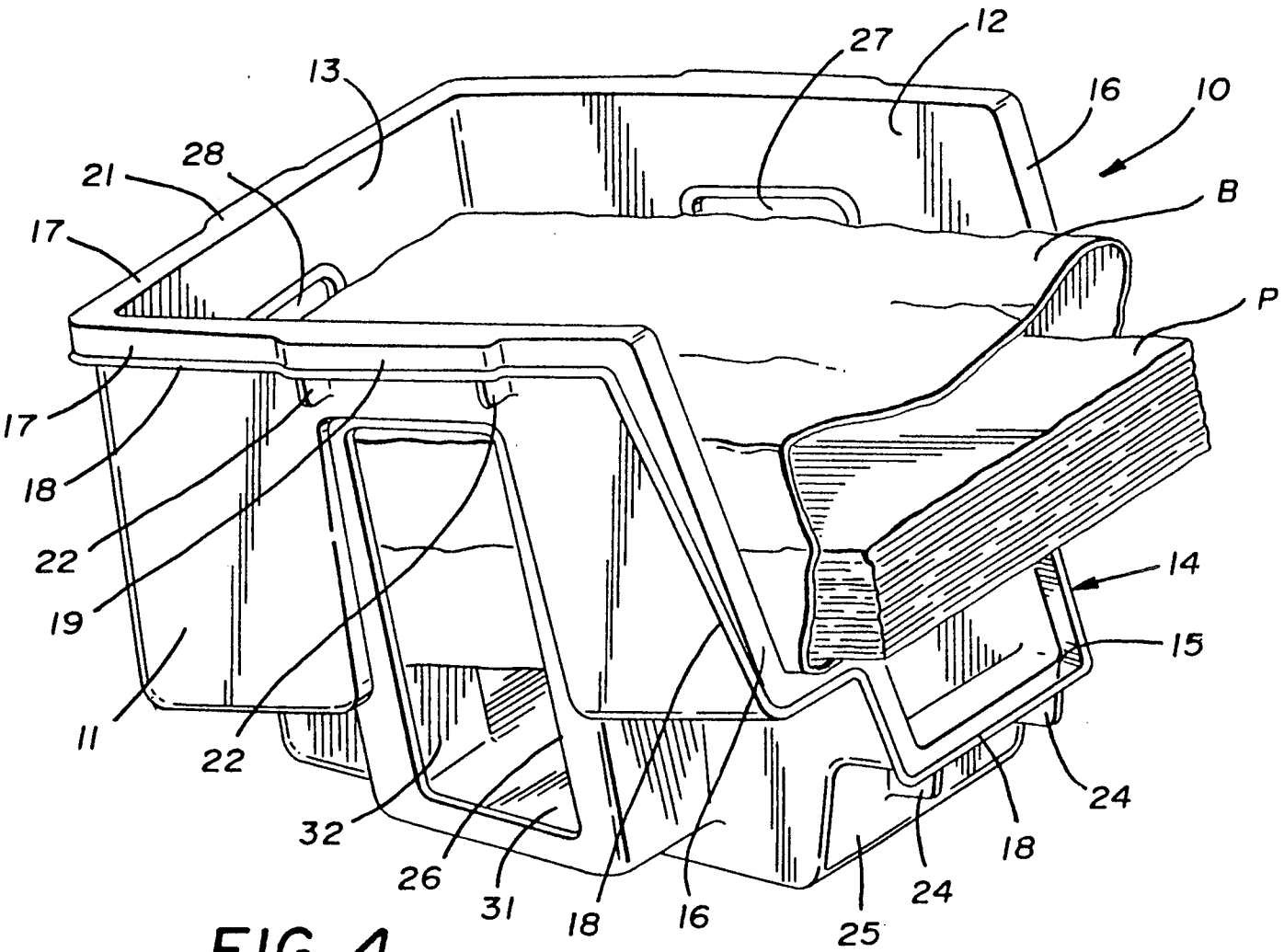
FIG. 4 is a perspective view like FIG. 1 but showing the container as being used to position newspapers in a paper bag.

As shown in FIG. 4, container 10 is quite versatile in that it may also be utilized in conjunction with a paper bag B to hold newspapers P. Container 10 can be readily sized to accommodate a conventional paper grocery bag B and when bag B is placed on pedestal surfaces 34, 35, 36 and 37, its open mouth extends through the open front surface. Because of the slope of surfaces 34, 35, 36 and 37, the mouth of bag B is positioned somewhat upwardly thereby permitting the facile positioning of newspapers P therein.

Figure 2:
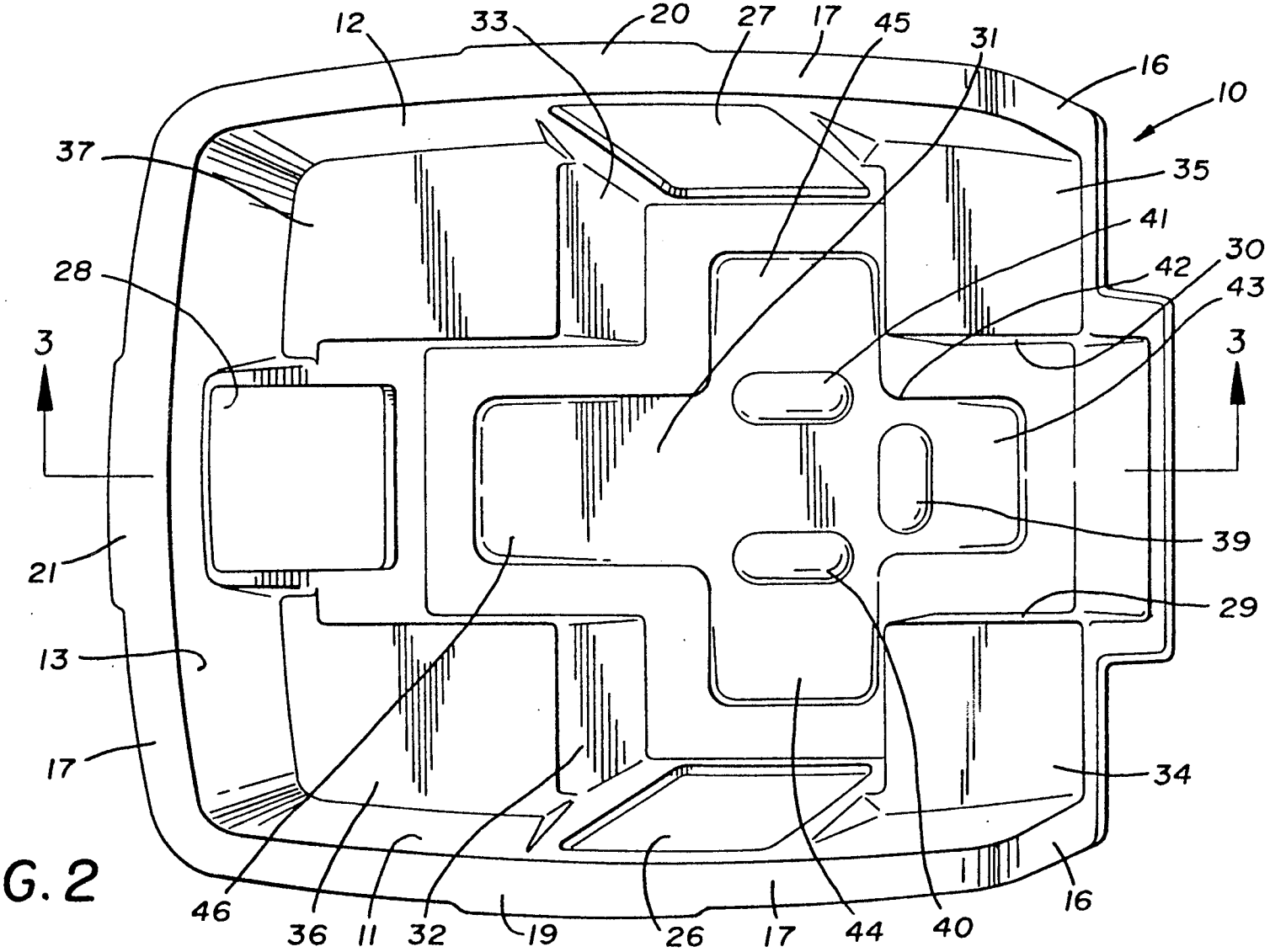
FIG. 2 is a top plan view thereof.
Figure 3:
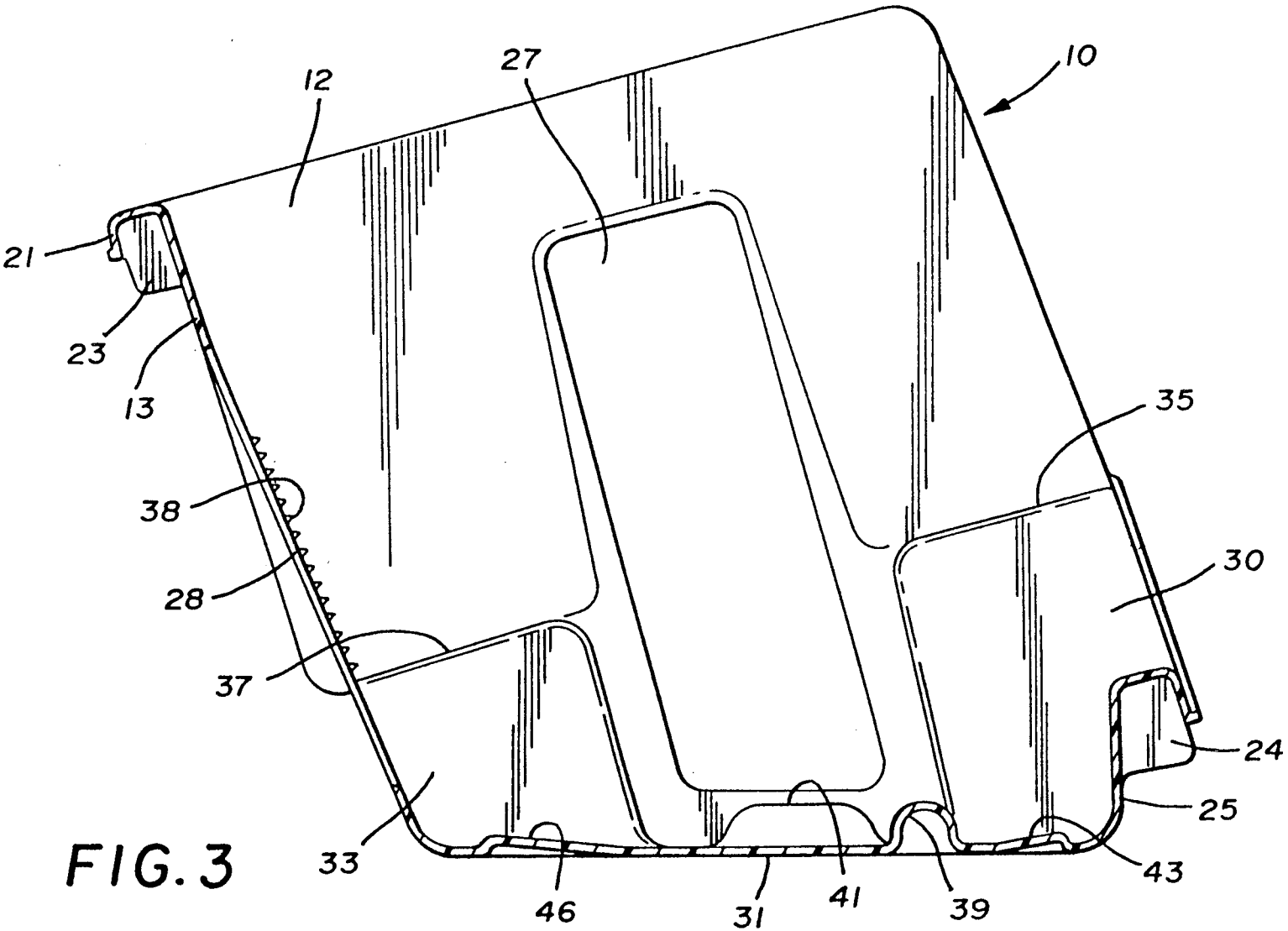
FIG. 3 is a sectional view taken substantially along line 3—3 of FIG. 2.

Of course, as previously described, container 10 may receive the newspapers directly to be bundled, if desired, with twine, cord or the like. The configuration of bottom surface 31, now to be described, assists in the bundling operation. As shown in FIGS. 2 and 3, bottom surface 31 is provided with a capsule shaped raised stop surface 39 positioned generally adjacent to the front opening of container 10 and between pedestals 29 and 30. Similar stop surfaces 40 and 41 are positioned generally adjacent to and aligned with windows 26 and 27, respectively.

Bottom surface 31 can also include a cross-shaped ramped surface, generally indicated by the numeral 42, which has ramp branches 43, 44, 45 and 46. Together branches 43, 44, 45 and 46 form a footprint for the bottom of container 10 and individually, branches 43, 44 and 45 cooperate with stop surfaces 39, 40 and 41, respectively, to locate balls of twine, rope or the like if the newspaper is to be bundled.

In order to bundle newspapers or the like utilizing container 10, and assuming that the newspaper is to be bundled with two pieces of twine or rope oriented 90° of each other around the newspaper, the user would usually first tie the loose end of the twine from a ball of twine around the upper rim 17 of rear wall 13. That is, the twine would be passed through window 28, looped over rear wall 13 and rim 17 generally at the area of handle 21, and then loosely tied thereto. Then the ball of twine is slightly unwound and draped over bottom surface 31 from the back to the front of container 10. The ball of twine can then be positioned on ramp surface 43 and conveniently located thereon for retrieval by stop surface 39.

Similarly, the second bundling twine, if such is desired, can be tied to rim 17, either through window 26 or window 27, draped across the bottom surface 31 of container 10 from side to side, and the ball conveniently positioned on the opposite side from that to which the twine is attached. As such, the ball is either positioned on ramp surface 44 and located by stop surface 40 or on ramp surface 45 and located by stop surface 41, to be easily retrieved when container 10 is full of newspaper. At that time, the twine is merely wrapped around the paper, cut and tied, and the bundle is ready for removal.

It should thus be evident that a paper bundling container constructed according to the concepts of the present invention, as described herein, accomplishes the objects of the present invention and otherwise improves the art.

We claim:

1. A container for stacking and bundling newspapers and the like comprising a rear wall, two opposed side walls, a rim at the top of said rear wall and said side walls, said rim on said side walls extending downwardly to form a front rim defining a generally open front, stacking ribs extending downwardly from said rim along said side walls and said rear wall and extending downwardly from said front rim below said open front, first pedestals near the front of each said side wall, second pedestals near the rear of each said side wall, each of said pedestals having an inclined upper surface, said upper surfaces lying in the same plane and providing support for the newspapers positioned therein.

2. A container according to claim 1 further comprising a window in each said side wall positioned between said first and second pedestals of each said side wall.

3. A container according to claim 2 further comprising a window in said rear wall positioned between said second pedestals.

4. A container according to claim 3 further comprising a bottom surface, said side walls and said rear wall extending upwardly from said bottom surface.

5. A container according to claim 4 further comprising raised stop surfaces in said bottom surface generally aligned with said windows in said side walls.

6. A container according to claim 5 further comprising an additional raised stop surface in said bottom surface positioned near said open front and generally between said first pedestals.

7. A container for stacking and bundling newspapers and the like comprising a bottom surface, a rear wall extending upwardly from said bottom surface, two opposed side walls extending upwardly from said bottom surface and defining an open front, first pedestals near the front of each said side wall, second pedestals near the rear of each said side wall, each of said pedestals having an inclined upper surface, said upper surfaces lying in the same plane and providing support for the newspapers positioned thereon, a window in each said side wall positioned between said first and second pedestals of each said side wall, raised stop surfaces in said bottom surface generally aligned with each said window in each said side wall, and side ramp surfaces in said bottom surface inclined downwardly from said windows in said side walls toward said raised stop surfaces.

8. A container according to claim 7 further comprising an additional raised stop surface in said bottom surface positioned near said open front and generally between said first pedestals, and a front ramp surface in said bottom surface inclined downwardly from said open front toward said additional raised stop surface.

9. A container according to claim 1 wherein said first pedestals are higher than said second pedestals and said incline of the upper surfaces of said pedestals is therefore rearwardly downwardly.

10. A container according to claim 9 wherein said incline is approximately 15° from horizontal.

11. A container according to claim 1 further comprising a bottom surface supporting said pedestals.

12. A container according to claim 11 further comprising first and second raised stop surfaces in said bottom surface positioned generally adjacent to a position between said first and second pedestals.

13. A container according to claim 12 further comprising a third raised stop surface in said bottom surface positioned generally between said first pedestals.

14. A container according to claim 12 further comprising a window in each said side wall positioned between said first and second pedestals of each said side wall and generally aligned with said first and second raised stop surface.

15. A container according to claim 14 further comprising a window in said rear wall positioned between said second pedestals.

16. A container according to claim 15 further comprising ramp surfaces in said bottom surface inclined downwardly from said windows toward said stop surfaces.

17. A container according to claim 16 further comprising a third raised stop surface in said bottom surface positioned generally between said first pedestals, and an additional ramp surface in said bottom surface inclined downwardly from said open front toward said third raised stop surface.

18. A container according to claim 7 further comprising a rim at the top of said rear wall and said side walls and extending to define said open front, and a handle formed on said rim on each said side wall and said rear wall.

19. A container according to claim 18 further comprising stacking ribs extending downwardly from said rim along said side walls and along said rear walls generally beneath said handles, and extending downwardly from said rim below said open front.

20. A container for stacking and bundling newspapers and the like comprising a generally horizontal bottom surface, a rear wall extending upwardly from said bottom surface, two opposed side walls extending upwardly from said bottom surface, an open front defined by a front rim, first pedestals extending upwardly from said bottom surface near the front of each said side wall, second pedestals extending upwardly from said bottom surface near the rear of each said side wall, each of said pedestals having an inclined upper surface lying in the same plane, said second pedestals being lower than said first pedestals so that newspapers positioned thereon are inclined upwardly from rear to front and extend out through said open front, and means formed in said bottom surface to automatically accessibly position a ball of twine or the like to be used to tie the newspapers.

* * * * *